US010018168B2

(12) United States Patent
Grandi et al.

(10) Patent No.: US 10,018,168 B2
(45) Date of Patent: Jul. 10, 2018

(54) FUEL INJECTOR AND FUEL-INJECTION SYSTEM

(71) Applicant: Continental Automotive GmbH, Hannover (DE)

(72) Inventors: Mauro Grandi, Leghorn (IT); Francesco Lenzi, Leghorn (IT); Giandomenico Serra, Ghezzano-S. Giuliano Terme (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 62 days.

(21) Appl. No.: 15/029,913

(22) PCT Filed: Oct. 14, 2014

(86) PCT No.: PCT/EP2014/071942
§ 371 (c)(1),
(2) Date: Apr. 15, 2016

(87) PCT Pub. No.: WO2015/055603
PCT Pub. Date: Apr. 23, 2015

(65) Prior Publication Data

US 2016/0230723 A1 Aug. 11, 2016

(30) Foreign Application Priority Data

Oct. 15, 2013 (EP) ..... 13188642

(51) Int. Cl.
*F02M 61/14* (2006.01)
*F02M 61/16* (2006.01)
*F02M 51/06* (2006.01)

(52) U.S. Cl.
CPC ..... *F02M 61/14* (2013.01); *F02M 51/0671* (2013.01); *F02M 61/166* (2013.01); *F02M 2200/857* (2013.01); *F02M 2200/858* (2013.01)

(58) Field of Classification Search
CPC .. F02M 51/0671; F02M 61/14; F02M 61/166; F02M 2200/857; F02M 2200/858
(Continued)

(56) References Cited

U.S. PATENT DOCUMENTS 2,459,286 A * 1/1949 Wiegand ..... F02M 57/06 137/542
6,807,945 B2 10/2004 Reiter et al. ..... 123/470
(Continued)

FOREIGN PATENT DOCUMENTS

JP 2010127193 A 6/2010 ..... F02F 1/24
JP 2010138809 A 6/2010 ..... F02M 61/12
(Continued)

OTHER PUBLICATIONS

Korean Notice of Allowance, Application No. 2017049784994, 3 pages, dated Jul. 18, 2017.
(Continued)

*Primary Examiner* — Mahmoud Gimie
(74) *Attorney, Agent, or Firm* — Slayden Grubert Beard PLLC

(57) ABSTRACT

The disclosure relates to a fuel injector with a housing, a valve body, and an adjustment element. The body may have a central area, an end area, and a transition area, with a first outer diameter in the central area, and a second outer diameter in the end area smaller than the first diameter. The adjustment element may be in the transition area to align the fuel injector relative to the recess. In the transition area, an outer diameter of the valve body decreases in stepped
(Continued)

fashion from the first diameter to the second diameter in a radially extending step. The adjustment element comprises a ring element through which the transition area extends with a radially extending upper surface which radially overlaps, contacts, and is coplanar to the step and a spherically shaped external surface in a cylinder head contact area.

9 Claims, 5 Drawing Sheets

(58) Field of Classification Search
USPC ..... 123/294, 470, 467, 468, 469
See application file for complete search history.

(56) References Cited

U.S. PATENT DOCUMENTS

| | | | | |
|---|---|---|---|---|
| 6,848,425 | B2 | 2/2005 | Raimann | 123/470 |
| 2003/0183201 | A1 | 10/2003 | Hans | 123/470 |
| 2003/0201612 | A1* | 10/2003 | Neumaier | F02M 61/14 277/591 |
| 2011/0232608 | A1 | 9/2011 | Ramamurthy | 123/470 |
| 2011/0247591 | A1* | 10/2011 | Holt | F02M 61/14 123/470 |

FOREIGN PATENT DOCUMENTS

| | | | | |
|---|---|---|---|---|
| JP | 2010185323 | A | 8/2010 | F02M 61/14 |
| WO | 02/066822 | A1 | 8/2002 | F02M 51/06 |
| WO | 2003/027486 | A1 | 4/2003 | F02M 57/00 |
| WO | 2011/163110 | A1 | 12/2011 | F02M 61/14 |
| WO | 2015/055603 | A1 | 4/2015 | F02M 61/14 |

OTHER PUBLICATIONS

European Search Report, Application No. 13188642.6, 6 pages, dated Jan. 27, 2014.
International Search Report and Written Opinion, Application No. PCT/EP2014/071942, 12 pages, dated Jan. 16, 2015.

* cited by examiner

FUEL INJECTOR AND FUEL-INJECTION SYSTEM

CROSS-REFERENCE TO RELATED APPLICATIONS

This application is a U.S. National Stage Application of International Application No. PCT/EP2014/071942 filed Oct. 14, 2014, which designates the United States of America, and claims priority to EP Application No. 13188642.6 filed Oct. 15, 2013, the contents of which are hereby incorporated by reference in their entirety.

TECHNICAL FIELD

The present disclosure relates to internal combustion engines and, in particular to fuel injectors and fuel-injection systems.

BACKGROUND

Fuel injectors are in widespread use, in particular for internal combustion engines, where they may be arranged in order to dose fuel into an intake manifold of the internal combustion engine or directly into the combustion chamber of a cylinder of the internal combustion engine. Fuel can be supplied to the internal combustion engine by the fuel injectors of the fuel-injection system.

The fuel injectors can be coupled to the cylinder head of the internal combustion engine in different manners. The coupling of the fuel injectors to the cylinder heads needs to be very precise to get a correct injection angle.

SUMMARY

The teachings of the present disclosure relate to fuel injectors for a cylinder head of a combustion engine which can be manufactured in a simple manner and which facilitates a reliable and precise coupling between the individual fuel injectors and the cylinder head of the combustion engine. It may furthermore relate to a fuel-injection system that ensures a precise dosing of fuel.

In some embodiments, a fuel injector including a central longitudinal axis is arranged in a recess of a cylinder head of a combustion engine. The fuel injector comprises a housing, a valve body, and an adjustment element. The housing may comprise a plastic housing in some embodiment. In other embodiments, the housing additionally or alternatively comprises a yoke of an electromagnetic actuator assembly of the fuel injector. The valve body may be a metallic body. The valve body may have a tubular shape that defines a cavity for hydraulically coupling a fuel inlet portion of the fuel injector to a fuel outlet portion of the fuel injector.

The valve body comprises a central area, an end area, and a transition area. In the central area, the valve body has a first outer diameter and is at least partly surrounded by the housing. In the end area, the valve body has a second outer diameter, which is smaller than the first outer diameter. The transition area is arranged between the central area and the end area, in particular in longitudinal direction.

In some embodiments, the adjustment element is shaped in such fashion and is positioned in the transition area of the valve body so as to be arranged in the recess of the cylinder head between the valve body and a first step of the recess to align the fuel injector relative to the recess in a radial and/or an axial direction.

In some embodiments, an outer diameter of the valve body decreases in the transition area from the first outer diameter in a first portion of the transition area to the second outer diameter in a second portion of the transition area. The adjustment element may be arranged at least in the second portion of the transition area and axially spaced apart from the housing. In some embodiments, there is no axial overlap between the first portion of the transition area and the adjustment element. In some embodiments, the outer diameter of the valve body decreases in stepped fashion from the first to the second portion of the transition area so that a radially extending step surface is formed in the outer surface of the valve body and the second portion in particular has the second outer diameter.

In this way, fuel injector detaching and fuel injector leaking because of welding breakdowns can reliably be avoided. At high pressures, the weakest zones of the fuel injector are welding connections between the valve body and an adapter element, e.g., an o-ring adapter. The adapter element supports a mechanical and hydraulic coupling of the fluid injector to a fluid reservoir, such as a fuel rail. By the special arrangement of the adjustment element, a mechanical stress in these weldings is decreased by changing stress conditions of the whole fuel injector. Consequently, a reliable functioning of the fuel injector is also possible at higher pressures.

The arrangement of the adjustment element ensures a correct position of a fuel injector tip inside the combustion chamber. Consequently, negative impacts on engine emission and performance due to an incorrect position of the fuel injector tip can be avoided.

In some embodiments, a cross-sectional shape of the adjustment element is adapted to a profile of the fuel injector in the transition area. This allows for a reliable and better alignment of the fuel injector in the recess. In some embodiments, the adjustment element has a radially extending upper surface which faces towards the step surface of the transition area and radially overlaps the step surface. The upper surface may contact the step surface. In some embodiments, the upper surface and the step surface are coplanar. In some embodiments, the adjustment element additionally or alternatively has a central axial opening through which the second portion of the transition area extends. Expediently, the diameter of the central axial opening is smaller than the first outer diameter. In this way, a reliable and precise positioning of the adjustment element with respect to the valve body is achievable.

In some embodiments, the adjustment element is of a material comprising aluminum and/or a stainless steel. This allows for a good contact between the adjustment element and the cylinder head. The adjustment element can be of different materials, but it is advantageous to adapt the material to a material of the cylinder head to reach a desired imprinting effect on the cylinder head.

In some embodiments, the adjustment element is a ring element comprising a spherically shaped external surface in a cylinder head contact area. The external surface of the adjustment element in particular faces away from the valve body and is provided for contacting the cylinder head.

In some embodiments, a fuel-injection system with a cylinder head of an internal combustion engine and a fuel injector according to the first aspect of the invention is specified. The fuel-injection system may also be denoted as a fuel-injection arrangement. The fuel injector is arranged in a recess of the cylinder head. In some embodiments, the adjustment element abuts the recess of the cylinder head and the valve body of the fuel injector.

The cylinder head may have a conical shape in the cylinder head contact area so that a cone-sphere coupling is achievable with the spherically shaped external surface of the adjustment element. This has the advantages that an inclination of the fuel injector during assembly can be adjusted. In this way it is possible to recover angular and dimensional tolerances of the fuel injector, and a correct functioning of the fuel injector and a desired fuel spray targeting inside the combustion chamber can be ensured.

In some embodiments, the housing is spaced apart from the cylinder head. In this way, the risk of mechanical damage to the fuel injector due to mechanical stress transferred from the cylinder head to the injector via the housing is particularly low.

BRIEF DESCRIPTION OF THE DRAWINGS

Exemplary embodiments of the invention are explained in the following with the aid of schematic drawings, wherein.

Elements of the same design and function that occur in different illustrations are identified by the same reference character.

DETAILED DESCRIPTION

Figure 1:
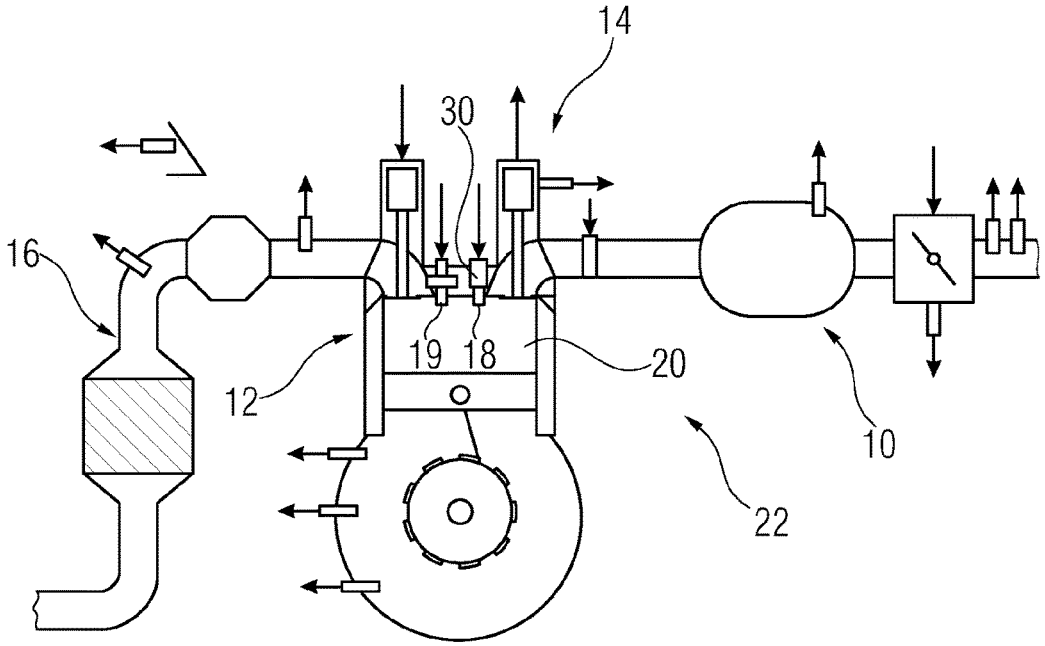
FIG. 1 shows an internal combustion engine in a schematic view.

FIG. 1 shows an internal combustion engine 22, with an intake air tract 10, a motor block 12, a cylinder head 14 and an exhaust gas tract 16. In the motor block 12 a combustion chamber 20 is arranged.

The cylinder head 14 comprises one or more recesses 15 in which at least one fuel injector 18 and at least one sparking plug 19 are arranged. The valve body 26 is at least partially in engagement with the recess 15. An adjustment element 30 is arranged in the recess 15 and allows the fuel injector 18 to be adjusted relative to the cylinder head 14 of the combustion engine 22. The fuel injector 18 is preferably used for high fuel pressures. Therefore, the fuel injector 18 might be clamped on the cylinder head 14 to ensure a correct positioning of its tip inside the combustion engine 22.

The fuel injector 18 (FIG. 2) comprises an injector coupling portion 24 and a valve assembly 27. The injector coupling portion 24 is configured to be coupled to a high-pressure fuel chamber of the internal combustion engine 22, in which the fuel is stored under high pressure. The high-pressure fuel chamber is in particular a fuel rail.

Furthermore, the injector coupling portion 24 is configured to be coupled to an electrical supply to actuate an actuator unit of the fuel injector 18.

The fuel injector 18 comprises a central longitudinal axis L, a housing 25, a valve body 26 with a cavity 32 which is axially led through the valve body 26 from a fuel inlet portion to a fuel outlet portion of the fuel injector 18. The fuel injector 18 further comprises a valve needle 34 accommodated in the cavity 32 of the valve body 26. On a free end of the fuel injector 18, i.e. at the fuel outlet portion, an injection nozzle 28 is formed which is closed or opened by an axial movement of the valve needle 34. In a closing position, a fuel flow through the injection nozzle 28 is prevented. In an opening position, fuel can flow through the injection nozzle 28 into the combustion chamber 20 of the internal combustion engine 22.

The valve body 26 is made from a metal or an alloy, in particular from steel, i.e. it is a metallic body. The valve body 26 is a generally tubular body (see, for example, FIG. 3) which comprises a central area 36, an end area 38 and a transition area 40. In the central area 36, the valve body 26 has a first outer diameter D1 and is at least partly surrounded by the housing 25. In the end area 38, the valve body 26 has a second outer diameter D2, which is smaller than the first outer diameter D1.

The transition area 40 is axially arranged between the central area 36 and the end area 38. The transition area 40 has a first portion 410 which has the first outer diameter D1 and a second section 420 which has the second outer diameter D2 (see FIG. 4, for example). The outer diameter of the valve body 26 decreases in stepped fashion from the first portion 410 to the second section 420 of the transition area 40 so that a radially extending step surface 411 is formed in the outer circumferential surface of the valve body 26. The step surface 411 is a planar surface having a surface normal parallel to the longitudinal axis L.

To house the fuel injector, the cylinder head 14 of the internal combustion engine has a recess 15 (FIG. 2) communicating with a combustion chamber 20 of the internal combustion engine 22. The recess 15 extends in the cylinder head 14 coaxially with the central longitudinal axis L of the fuel injector. The recess 15 has a first section 42 communicating with the combustion chamber and is able to be engaged by the end area 38 of the fuel injector, in which the injection nozzle 28 is arranged; a second section 44 of mainly cylindrical form, able to be engaged by the housing 25 of the fuel injector; and finally an intermediate section 46 connecting the first and second portions 42, 44 with one another. The recess 15 comprises a first step 48 at a transition between the first and intermediate section 42, 46 and a second step 50 at a transition between the intermediate section 46 and second section 44.

Figure 2:
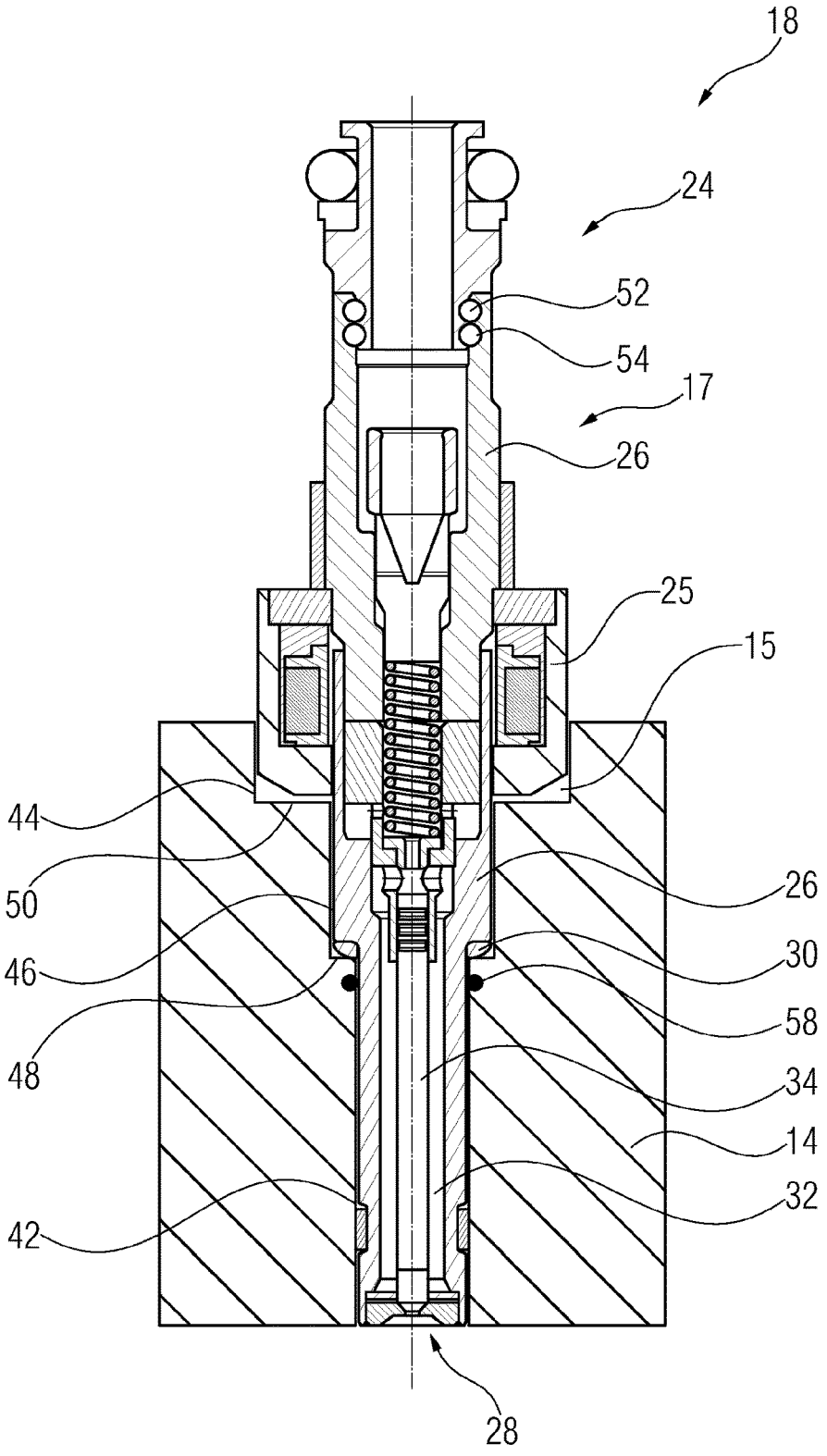
FIG. 2 shows a fuel injector and a cylinder head in a schematic longitudinal section view.
Figure 4:
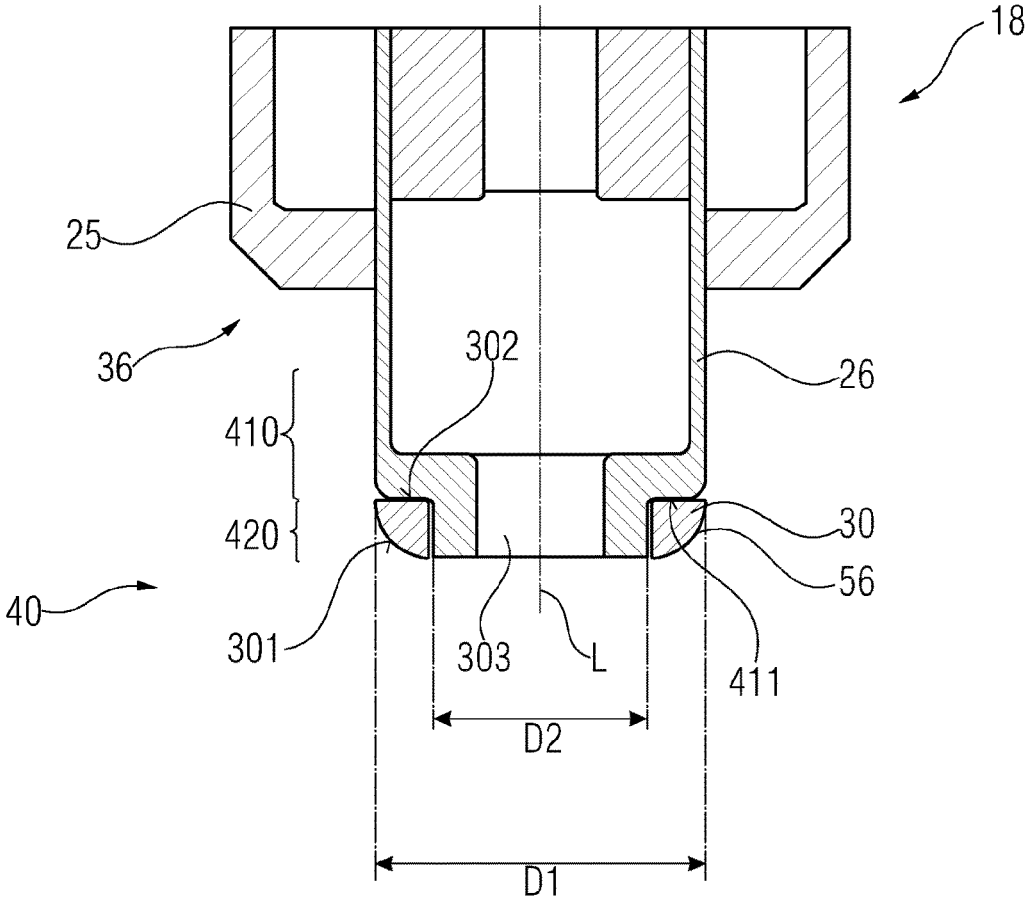
FIG. 4 shows an example of the adjustment element in a detail of a longitudinal section view of a fuel injector and FIG. 5 shows a perspective view of the adjustment element of FIG. 3.

The fuel injector comprises the adjustment element 30 (see, for example, FIG. 2 or FIG. 4). The adjustment element 30 is shaped and positioned to be arranged in the recess 15 of the cylinder head 14 in the transition area 40 of the valve body 26 between the valve body 26 and the first step 48 of the recess 15 of the cylinder head 14 to align the fuel injector relative to the recess 15 in a radial and/or an axial direction. In particular, the adjustment element 30 is arranged in the second portion 420 of the transition area 40, axially spaced apart from the housing 25. It abuts the step surface 411 of the transition region 40.

Figure 3:
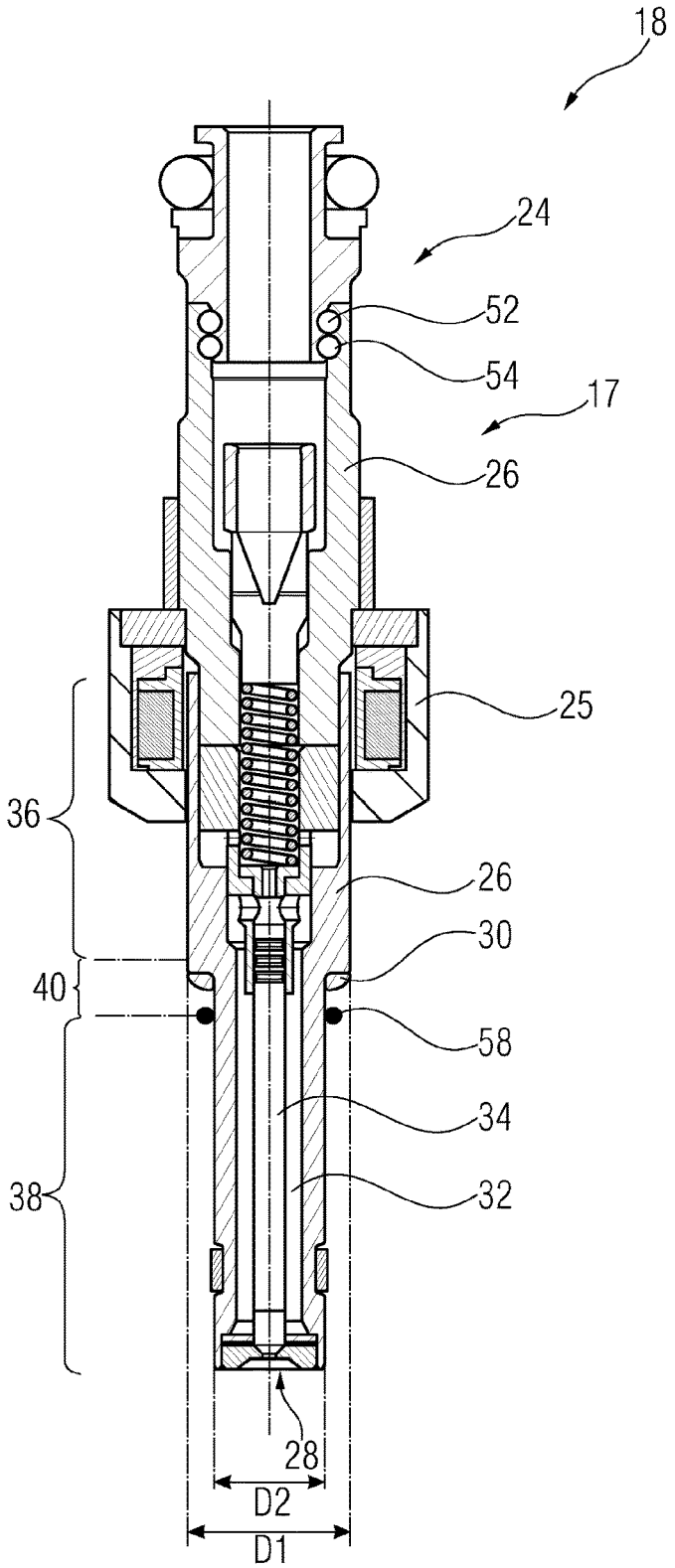
FIG. 3 shows the fuel injector with an adjustment element in a longitudinal section view.

FIGS. 2 and 3 show the fuel injector comprising a first and a second welding 52, 54, which connect an adapter element, for instance an O-ring adapter, with the valve body 26. The first and second weldings 52, 54 are stressed because of an internal pressure inside the fuel injector, which tends to separate the valve body 26 from the adapter. With higher pressures there is the problem that vertical forces may be transferred to the weldings 52, 54 from the cylinder head 14 through the housing 25, in particular if the injector 18 was fixed to the cylinder head 14 via the housing 25 and/or if the housing 25 would contact the cylinder head 15. With the adjustment element 30 being arranged in the recess 15 of the cylinder head 14 in the transition area 40 of the valve body 26 between the valve body 26 and the first step 48 of the recess 15 of the cylinder head 14, that mechanical stress can be decreased and a breakdown of the first and second weldings 52, 54 and any deformation of the valve body 26 can be avoided by transforming in compression the traction stress caused by the pressure. In particular, the housing 25 is spaced apart from the cylinder head 15. Because of this stress transformation, the fuel injector is able to withstand higher pressures.

Figure 5:
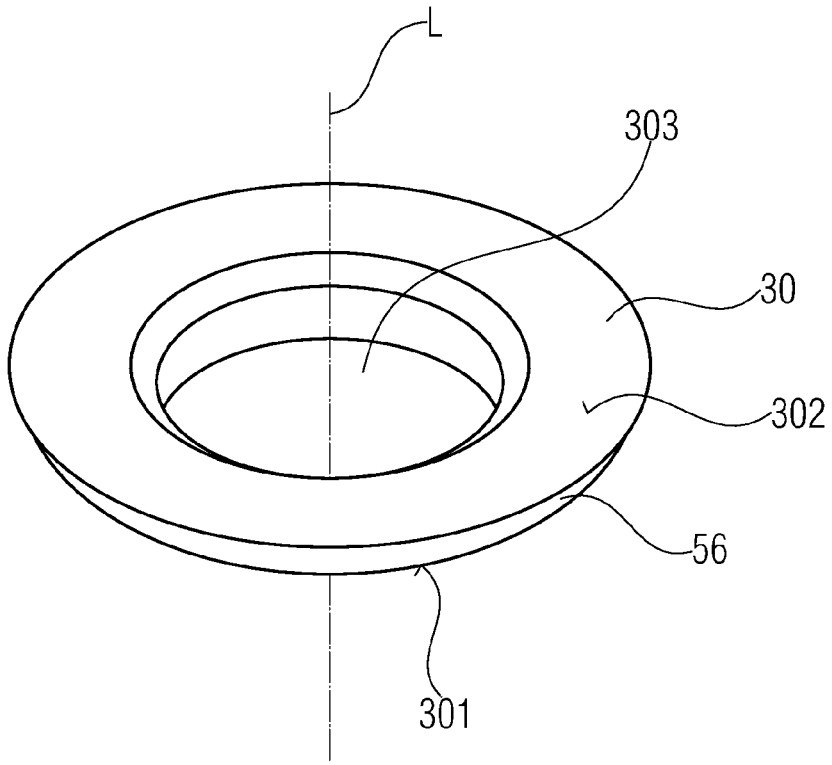

In the longitudinal sectional view of FIG. 4 the adjustment element 30 is shown in more detail. FIG. 5 shows a perspective view of the adjustment element 30.

For instance, the adjustment element 30 is a ring element comprising a spherically shaped external surface 301 in a cylinder head contact area 56. The roundness of the adjustment element 30 together with the conical shape of the recess 15 in the cylinder head contact area 56 provides a tilting ability of the fuel injector 18 to avoid the external leakage caused by the stress due to a miss-alignment between a fuel rail cup, the central longitudinal axis L of the fuel injector, and/or the recess 15.

For instance, a cross-sectional shape of the adjustment element 30 is adapted to a profile of the fuel injector in the transition area 40. More specifically, the adjustment element 30 has an upper surface 30 which is coplanar with the step surface 411 and contacts the step surface 411 over the full overlapping area. A central axial opening 303 of the adjustment element 30 has a diameter which is only slightly larger than the second outer diameter D2 of the valve body 26 so that the adjustment element 30 can be shifted over the end area 38 in contact with the step surface 411. In the mounted configuration, the second portion 420 of the transition area 40 extends through central axial opening 303 of the ring element which represents the adjustment element 30.

The adjustment element 30 is of a material comprising, for example, aluminum and/or a stainless steel.

The construction and arrangement of the adjustment element 30 allows for an exact alignment of the fuel injector 18 relative to the cylinder head 14 and a fast and simple disassembly of the fuel injector 18 from the cylinder head 14. Only the adjustment element 30 is needed and no further element, like a distance element or retaining element, is required.

In order to keep the adjustment element 30 packaged to the fuel injector, e.g., before inserting it into the recess 15, the fuel injector may comprise a snap-ring 58 (FIGS. 2 and 3), which is arranged between the adjustment element 30 and the end area 38 of the valve body 26. The snap-ring 58 may be coupled to the valve body 26 by an interference fit.

What is claimed is:

1. A fuel injector with a central longitudinal axis and arranged in a recess of a cylinder head of a combustion engine, the fuel injector comprising:

a housing, a valve body, and an adjustment element, the valve body comprising a central area, an end area, and a transition area, wherein:

in the central area the valve body has a first outer diameter (D1) and is at least partly surrounded by the housing, in the end area the valve body has a second outer diameter (D2), which is smaller than the first outer diameter (D1), and the transition area is arranged between the central area and the end area, the adjustment element surrounding at least a part of the transition area of the valve body, thereby arranged in the recess of the cylinder head between the valve body and a first step of the recess as to align the fuel injector relative to the recess in a radial and/or axial direction, wherein, in the transition area, an outer diameter of the valve body decreases in stepped fashion from the first outer diameter (D1) in a first portion of the transition area to the second outer diameter (D2) in a second portion of the transition area so that a radially extending step surface is formed and the adjustment element is arranged at least in the second portion of the transition area and is axially spaced apart from the housing, the adjustment element comprises a ring element which has a central axial opening through which the second portion of the transition area extends, and the adjustment element has a cross-sectional shape of a quarter circle with a radially extending flat upper surface which matches a radial extent of and is coplanar to the step surface, an axially extending flat inner surface which surrounds at least a part of the second portion of the transition area, and an external surface forming a quadrant in a cylinder head contact area.

2. A fuel injector in accordance with claim 1, wherein a cross-sectional shape of the adjustment element is adapted to a profile of the fuel injector in the transition area.

3. A fuel injector in accordance with claim 1, wherein the adjustment element comprises aluminum and/or a stainless steel.

4. A fuel injector in accordance with claim 1, wherein the valve body comprises a metallic body.

5. A fuel injector in accordance with claim 1, wherein the housing comprises a plastic housing and/or a yoke of an electromagnetic actuator assembly.

6. A fuel-injection system comprising:

a cylinder head of an internal combustion engine, a fuel injector arranged in a recess of the cylinder head, the fuel injector comprising:

a housing, a valve body, and an adjustment element, the valve body comprising a central area, an end area, and a transition area, wherein:

in the central area the valve body has a first outer diameter (D1) and is at least partly surrounded by the housing, in the end area the valve body has a second outer diameter (D2), which is smaller than the first outer diameter (D1), and the transition area is arranged between the central area and the end area, the adjustment element shaped and positioned in the transition area of the valve body, thereby arranged in the recess of the cylinder head between the valve body and a first step of the recess as to align the fuel injector relative to the recess in a radial and/or axial direction, wherein, in the transition area, an outer diameter of the valve body decreases in stepped fashion from the first outer diameter (D1) in a first portion of the transition area to the second outer diameter (D2) in a second portion of the transition area so that a radially extending step surface is formed and the adjustment element is arranged at least in the second portion of the transition area and is axially spaced apart from the housing, the adjustment element comprises a ring element which has a central axial opening through which the second portion of the transition area extends, and the adjustment element has a cross-sectional shape of a quarter circle with a radially extending flat upper surface which matches a radial extent of and is coplanar to the step surface, an axially extending flat inner surface which surrounds at least a part of the second portion of the transition area, and an external surface forming a quadrant in a cylinder head contact area.

7. A fuel-injection system according to claim 6, wherein the recess has a conical shape in the cylinder head contact area.

8. A fuel injection system according to claim 6, wherein the housing is spaced apart from the cylinder head.

9. An internal combustion engine comprising:

one or more combustion chambers arrayed in a cylinder block, a cylinder head joined to the cylinder block, a fuel injector arranged in a recess of the cylinder head and positioned to dose fuel into one of the one or more combustion chambers, the fuel injector comprising:

a housing, a valve body, and an adjustment element, the valve body comprising a central area, an end area, and a transition area, wherein:

in the central area the valve body has a first outer diameter (D1) and is at least partly surrounded by the housing, in the end area the valve body has a second outer diameter (D2), which is smaller than the first outer diameter (D1), and the transition area is arranged between the central area and the end area, the adjustment element shaped and positioned in the transition area of the valve body, thereby arranged in the recess of the cylinder head between the valve body and a first step of the recess as to align the fuel injector relative to the recess in a radial and/or axial direction, wherein, in the transition area, an outer diameter of the valve body decreases in stepped fashion from the first outer diameter (D1) in a first portion of the transition area to the second outer diameter (D2) in a second portion of the transition area so that a radially extending step surface is formed and the adjustment element is arranged at least in the second portion of the transition area and is axially spaced apart from the housing, the adjustment element comprises a ring element which has a central axial opening through which the second portion of the transition area extends, and the adjustment element has a cross-sectional shape of a quarter circle with a radially extending flat upper surface which matches a radial extent of and is coplanar to the step surface, an axially extending flat inner surface which surrounds at least a part of the second portion of the transition area, and an external surface forming a quadrant in a cylinder head contact area.

* * * * *